US010753608B2

(12) United States Patent
Cunha et al.

(10) Patent No.: US 10,753,608 B2
(45) Date of Patent: Aug. 25, 2020

(54) TURBINE ENGINE MULTI-WALLED STRUCTURE WITH INTERNAL COOLING ELEMENT(S)

(71) Applicant: United Technologies Corporation, Farmington, CT (US)

(72) Inventors: Frank J. Cunha, Avon, CT (US); Stanislav Kostka, Jr., Shrewsbury, MA (US)

(73) Assignee: Raytheon Technologies Corporation, Farmington, CT (US)

( * ) Notice: Subject to any disclaimer, the term of this patent is extended or adjusted under 35 U.S.C. 154(b) by 546 days.

(21) Appl. No.: 15/034,717

(22) PCT Filed: Nov. 21, 2014

(86) PCT No.: PCT/US2014/668887
§ 371 (c)(1),
(2) Date: May 5, 2016

(87) PCT Pub. No.: WO2015/122950
PCT Pub. Date: Aug. 20, 2015

(65) Prior Publication Data

US 2016/0265775 A1 Sep. 15, 2016

Related U.S. Application Data

(60) Provisional application No. 61/907,224, filed on Nov. 21, 2013.

(51) Int. Cl.
*F23R 3/00* (2006.01)
*F23M 5/00* (2006.01)
(Continued)

(52) U.S. Cl.
CPC ..... *F23R 3/002* (2013.01); *F23M 5/00* (2013.01); *F23M 5/08* (2013.01); *F23R 3/005* (2013.01);
(Continued)

(58) Field of Classification Search
CPC .. F23R 2900/03041; F23R 2900/03042; F23R 2900/03044; F23R 2900/03045;
(Continued)

(56) References Cited

U.S. PATENT DOCUMENTS 4,265,085 A 5/1981 Fox et al.
5,461,866 A 10/1995 Sullivan et al.
(Continued)

OTHER PUBLICATIONS

EP search report for EP14882767.8 dated Oct. 17, 2016.
Office action for EP14882767.8 dated Oct. 12, 2018.

*Primary Examiner* — Todd E Manahan
*Assistant Examiner* — Katheryn A Malatek
(74) *Attorney, Agent, or Firm* — Getz Balich LLC

(57) ABSTRACT

A structure is provided for a turbine engine. The structure includes a shell with a first surface, and a heat shield with a textured second surface and a textured third surface. The texture of a portion of the second surface is different than the texture of a portion of the third surface. The first surface and the second surface define a first cooling cavity between the shell and the heat shield. The first surface and the third surface define a second cooling cavity between the shell and the heat shield.

19 Claims, 11 Drawing Sheets

(51) Int. Cl.
*F23M 5/08* (2006.01)
*F23R 3/06* (2006.01)
*F23R 3/50* (2006.01)

(52) U.S. Cl.
CPC ..... *F23R 3/06* (2013.01); *F23R 3/50* (2013.01); *F23R 2900/03042* (2013.01); *F23R 2900/03044* (2013.01); *F23R 2900/03045* (2013.01)

(58) Field of Classification Search
CPC .... F23R 3/002; F23R 3/50; F23R 3/06; F02C 7/12
See application file for complete search history.

(56) References Cited

U.S. PATENT DOCUMENTS 5,758,503 A 6/1998 DuBell et al.
6,282,905 B1 * 9/2001 Sato ..... F23R 3/002 60/752
7,093,441 B2 8/2006 Burd et al.
7,146,815 B2 12/2006 Burd
8,443,610 B2 5/2013 Hoke et al.
2002/0124572 A1 * 9/2002 Pidcock ..... F23R 3/002 60/796
2005/0034399 A1 * 2/2005 Pidcock ..... F23R 3/002 52/506.1
2005/0086940 A1 4/2005 Coughlan, III et al.
2005/0262846 A1 12/2005 Pidcock et al.
2006/0042255 A1 * 3/2006 Bunker ..... F01D 25/12 60/752
2008/0115498 A1 5/2008 Patel et al.
2009/0013530 A1 * 1/2009 Rudrapatna ..... F23R 3/002 29/888
2010/0011775 A1 * 1/2010 Garry ..... C23C 4/02 60/752
2010/0251722 A1 10/2010 Woolford et al.
2010/0287941 A1 11/2010 Kim et al.
2011/0185735 A1 8/2011 Snyder
2012/0034075 A1 * 2/2012 Hsu ..... F01D 9/023 415/178
2013/0055722 A1 3/2013 Verhiel et al.
2014/0090402 A1 4/2014 Erbas-Sen et al.
2016/0123592 A1 5/2016 Drake et al.

* cited by examiner

TURBINE ENGINE MULTI-WALLED STRUCTURE WITH INTERNAL COOLING ELEMENT(S)

This application claims priority to PCT Patent Application No. PCT/US14/066887 filed Nov. 21, 2014 which claims priority to U.S. Patent Application No. 61/907,224 filed Nov. 21, 2013, which are hereby incorporated herein by reference in their entireties.

BACKGROUND OF THE INVENTION

1. Technical Field

This disclosure relates generally to a multi-walled structure of a turbine engine.

2. Background Information

A floating wall combustor for a turbine engine typically includes a bulkhead, an inner combustor wall and an outer combustor wall. The bulkhead extends radially between the inner and the outer combustor walls. Each combustor wall includes a shell and a heat shield that defines a respective radial side of a combustion chamber. Cooling cavities extend radially between the heat shield and the shell. These cooling cavities fluidly couple impingement apertures defined in the shell with effusion apertures defined in the heat shield.

There is a need in the art for an improved turbine engine combustor.

SUMMARY OF THE DISCLOSURE

According to an aspect of the invention, a structure is provided for a turbine engine. This structure includes a shell including a first surface, and a heat shield including a textured second surface and a textured third surface. The texture of a first portion of the second surface is different than the texture of a first portion of the third surface. The first surface and the second surface define a first cooling cavity between the shell and the heat shield. The first surface and the third surface define a second cooling cavity between the shell and the heat shield.

According to another aspect of the invention, another structure is provided for a turbine engine. This structure includes a shell and a heat shield with first and second cooling cavities between the shell and the heat shield. The shell includes a plurality of first cooling elements and a plurality of second cooling elements. The first cooling elements extend partially into the first cooling cavity, and one of the first cooling elements is configured as or otherwise includes a point protrusion. The second cooling elements extend partially into the second cooling cavity, and one of the second cooling elements is configured as or otherwise includes a rib.

According to another aspect of the invention, still another structure is provided for a turbine engine. This structure includes a shell and a heat shield with a cooling cavity between the shell and the heat shield. The cooling cavity fluidly couples cooling apertures defined in the shell with cooling apertures defined in heat shield. The heat shield includes a base that includes a first portion and a second portion. The first portion has a vertical thickness that is greater than a vertical thickness of the second portion.

The first cooling cavity may be defined vertically between a surface of the shell and a surface of the heat shield that converge towards one another. The second cooling cavity may also or alternatively be defined vertically between a surface of the shell and a surface of the heat shield that converge towards one another.

The heat shield may include a rail. The heat shield may define cooling apertures at the rail fluidly coupled with the first cooling cavity. The heat shield is configured to outwardly direct substantially all air entering the cooling cavity through the cooling apertures.

The heat shield may include a rail. The heat shield may define cooling apertures at the rail fluidly coupled with the second cooling cavity. The heat shield is configured to outwardly direct substantially all air entering the cooling cavity through the cooling apertures.

The heat shield may include a base that at least partially defines the first and the second cooling cavities. A first portion of the base may be thicker than a second portion of the base. The first portion may be circumferentially adjacent the second portion. Alternatively, the first portion may be axially adjacent the second portion.

The heat shield may define first cooling apertures at the first portion of the second surface with the first fooling apertures fluidly coupled with the first cooling cavity. The heat shield may also define second cooling apertures at the first portion of the third surface with the second cooling apertures fluidly coupled with the second cooling cavity.

The heat shield may include a rail between the second surface and the third surface. The texture of a second portion of the second surface at the rail may be substantially the same as (or different than) the texture of a second portion of the third surface at the rail.

The heat shield may include a plurality of first cooling elements that partially define the second surface. The heat shield may also or alternatively include a plurality of second cooling elements that partially define the third surface.

A density of the first cooling elements may be different than a density of the second cooling elements.

One of the first cooling elements may be configured as or otherwise include a point protrusion. One of the second cooling elements may be configured as or otherwise include a rib. The point protrusion may be configured as or otherwise include a nodule or a pin. At least a portion of the rib may be configured as a chevron.

The heat shield may define first cooling apertures that are fluidly coupled with the first cooling cavity. The heat shield may also define second cooling apertures that are fluidly coupled with the second cooling cavity. The point protrusion may be disposed next to one of the first cooling apertures. The rib may be disposed next to one or more of the second cooling apertures.

The heat shield may include first and second end rails. The heat shield may define the first cooling apertures at the first end rail, the second cooling apertures at the second end rail.

The first cooling cavity is configured to outwardly direct substantially all air which enters the first cooling cavity through the first apertures. In addition or alternatively, the second cooling cavity is configured to outwardly direct substantially all air which enters the second cooling cavity through the second apertures.

The heat shield may include a plurality of heat shield panels. One of the heat shield panels may include the second surface and the third surface.

The first cooling cavity may fluidly couple a plurality of cooling apertures defined in the shell with a plurality of cooling apertures defined in the heat shield at a rail. The heat shield may be configured such that substantially all air within the first cooling cavity is directed through the cooling apertures defined in the heat shield at the rail.

The heat shield may include a base that at least partially defines the second surface and the third surface. A first portion of the base may be thicker than a second portion of the base.

The foregoing features and the operation of the invention will become more apparent in light of the following description and the accompanying drawings.

DETAILED DESCRIPTION OF THE INVENTION

Figure 1:
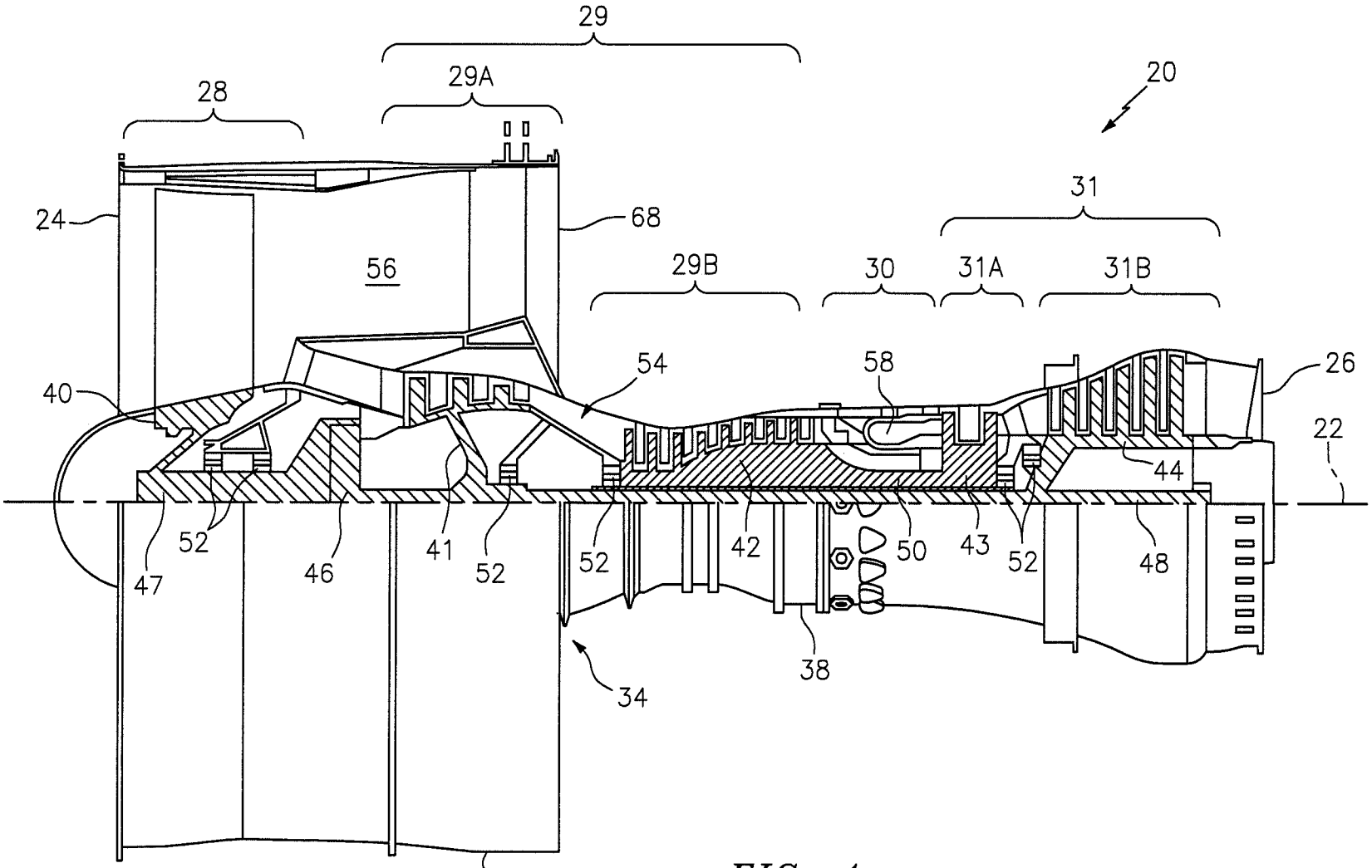
FIG. 1 is a side cutaway illustration of a geared turbine engine.

FIG. 1 is a side cutaway illustration of a geared turbine engine 20. This turbine engine 20 extends along an axial centerline 22 between a forward airflow inlet 24 and an aft airflow exhaust 26. The turbine engine 20 includes a fan section 28, a compressor section 29, a combustor section 30 and a turbine section 31. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B. The engine sections 28-31 are arranged sequentially along the centerline 22 within an engine housing 34, which includes a first engine case 36 and a second engine case 38.

Each of the engine sections 28, 29A, 29B, 31A and 31B includes a respective rotor 40-44. Each of the rotors 40-44 includes a plurality of rotor blades arranged circumferentially around and connected to (e.g., formed integral with or mechanically fastened, welded, brazed, adhered or otherwise attached to) one or more respective rotor disks. The fan rotor 40 is connected to a gear train 46 through a fan shaft 47. The gear train 46 and the LPC rotor 41 are connected to and driven by the LPT rotor 44 through a low speed shaft 48. The HPC rotor 42 is connected to and driven by the HPT rotor 43 through a high speed shaft 50. The shafts 47, 48 and 50 are rotatably supported by a plurality of bearings 52. Each of the bearings 52 is connected to the second engine case 38 by at least one stationary structure such as, for example, an annular support strut.

Air enters the turbine engine 20 through the airflow inlet 24, and is directed through the fan section 28 and into an annular core gas path 54 and an annular bypass gas path 56. The air within the core gas path 54 may be referred to as "core air". The air within the bypass gas path 56 may be referred to as "bypass air".

The core air is directed through the engine sections 29-31 and exits the turbine engine 20 through the airflow exhaust 26. Within the combustor section 30, fuel is injected into a combustion chamber 58 and mixed with the core air. This fuel-core air mixture is ignited to power the turbine engine 20 and provide forward engine thrust. The bypass air is directed through the bypass gas path 56 and out of the turbine engine 20 through a bypass nozzle 60 to provide additional forward engine thrust. Alternatively, the bypass air may be directed out of the turbine engine 20 through a thrust reverser to provide reverse engine thrust.

Figure 2:
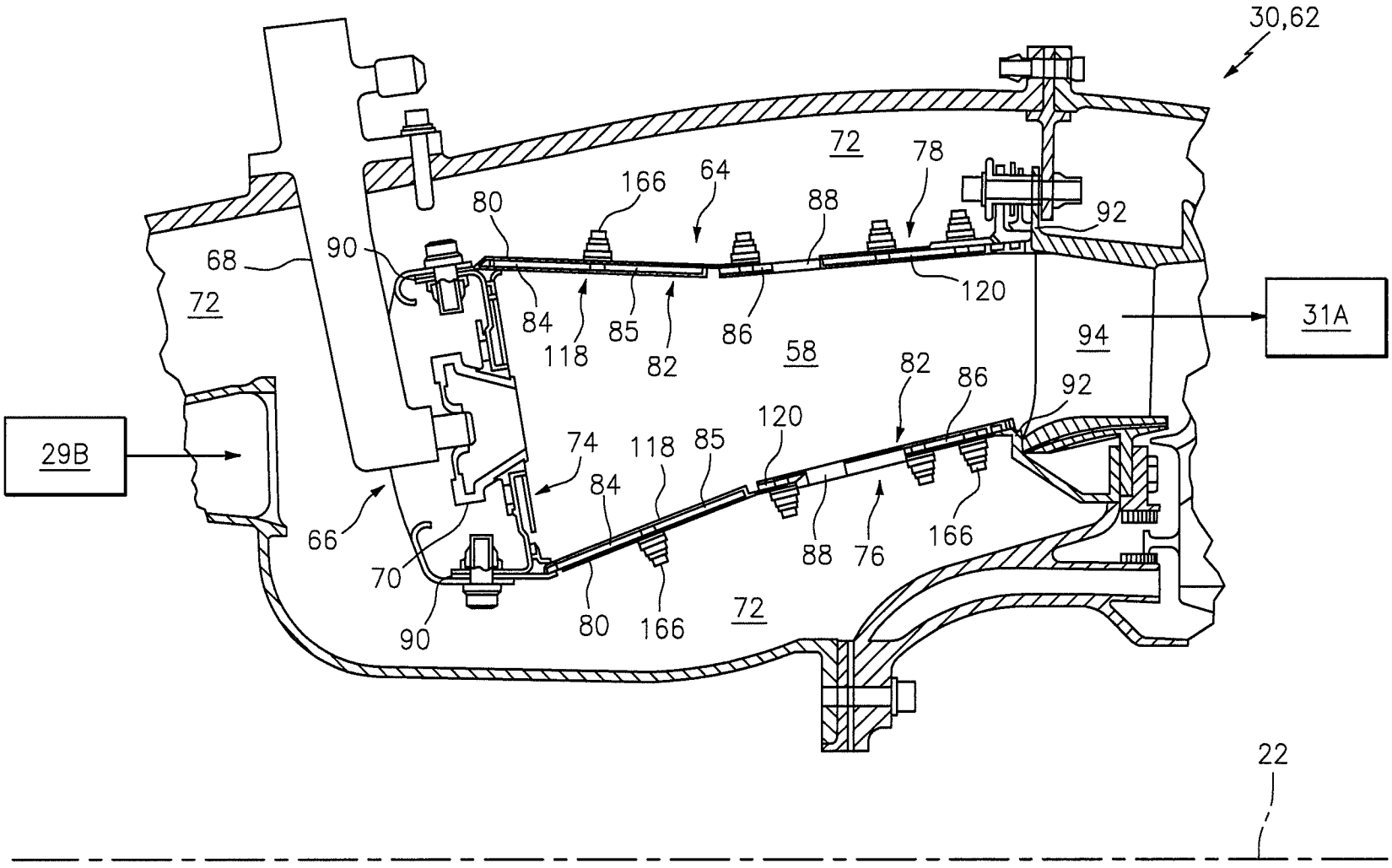
FIG. 2 is a side cutaway illustration of a portion of a combustor section.

FIG. 2 illustrates an assembly 62 of the turbine engine 20. This turbine engine assembly 62 includes a combustor 64 (see FIG. 3). The turbine engine assembly 62 also includes one or more fuel injector assemblies 66, each of which may include a fuel injector 68 mated with a swirler 70.

The combustor 64 may be configured as an annular floating wall combustor arranged within an annular plenum 72 of the combustor section 30. The combustor 64 of FIGS. 2 and 3, for example, includes an annular combustor bulkhead 74, a tubular combustor inner wall 76, and a tubular combustor outer wall 78. The bulkhead 74 extends radially between and is connected to the inner wall 76 and the outer wall 78. The inner wall 76 and the outer wall 78 each extends axially along the centerline 22 from the bulkhead 74 towards the turbine section 31A, thereby defining the combustion chamber 58.

Figure 4:
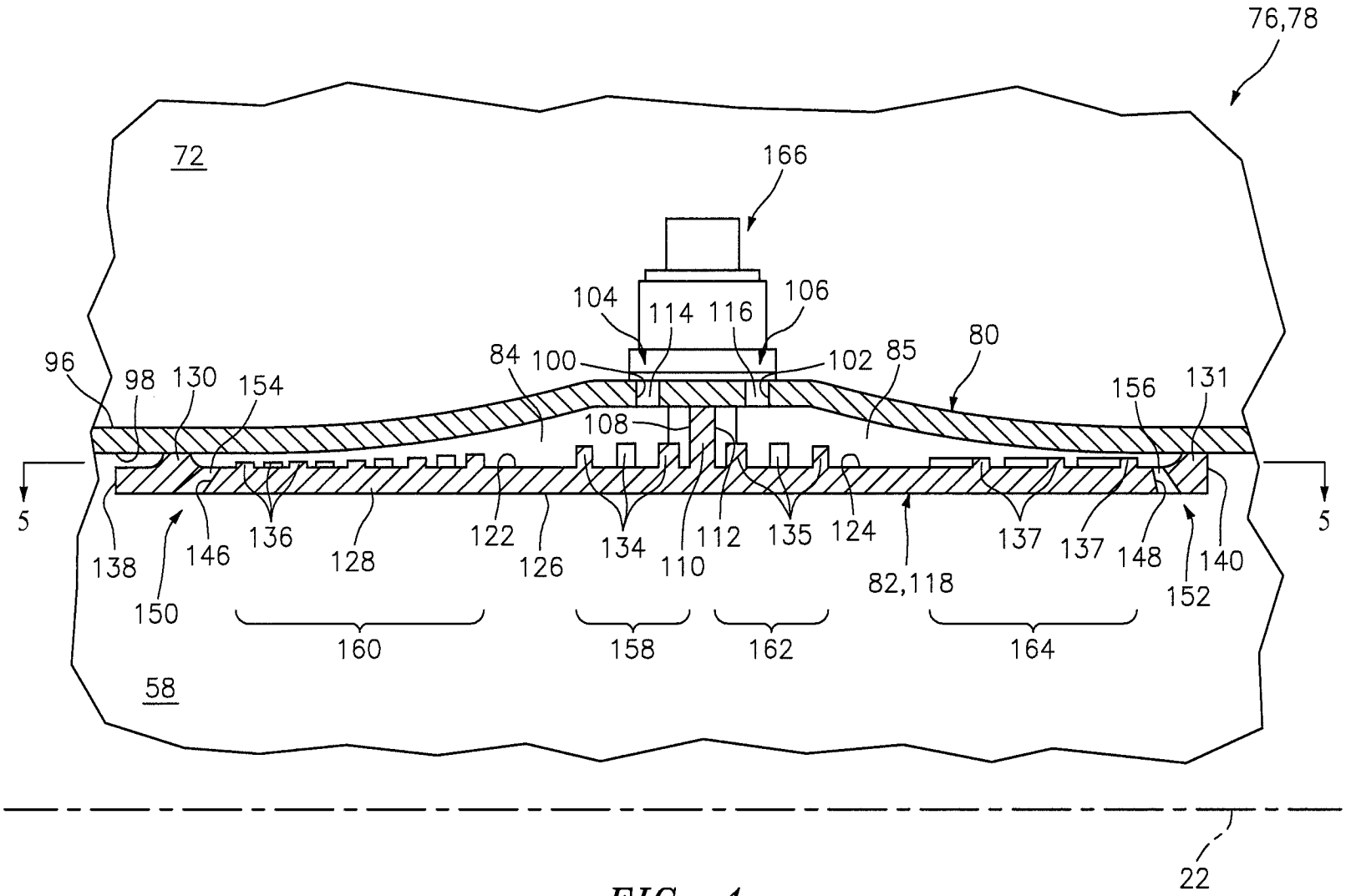
FIG. 4 is a side sectional illustration of a portion of a combustor wall.
Figure 5:
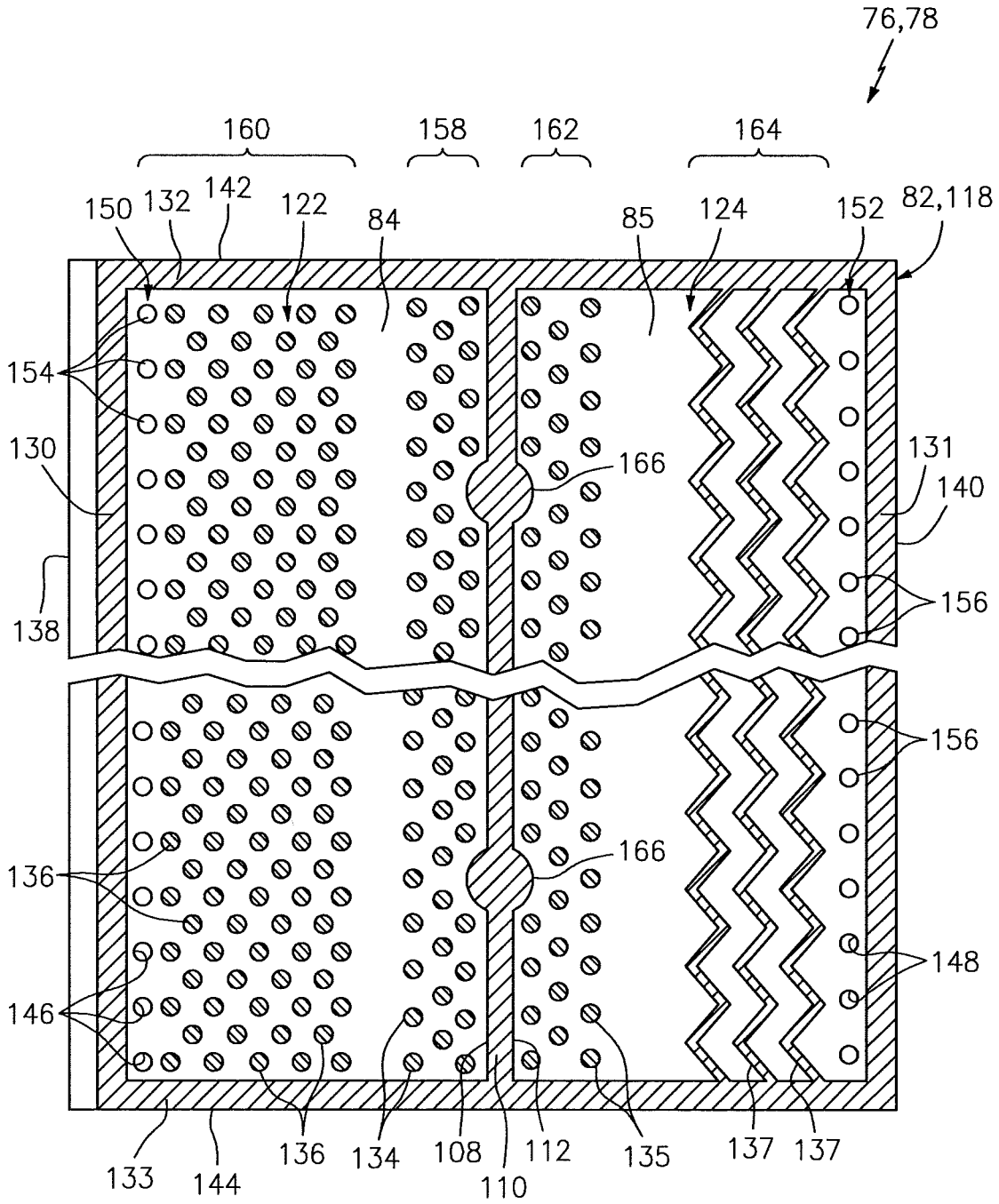
FIG. 5 is a circumferential sectional illustration of a portion of the combustor wall of FIG. 4.
Figure 6:
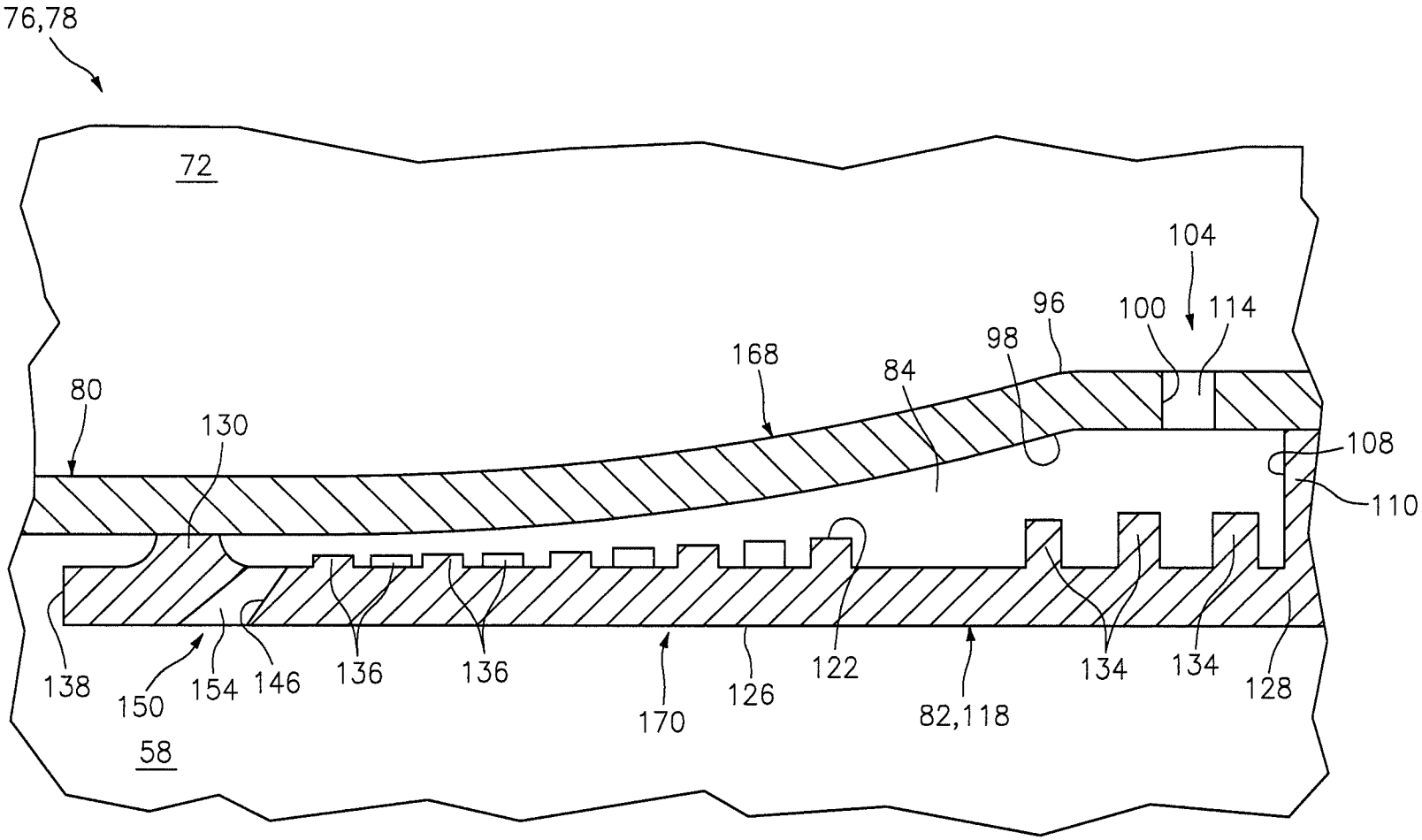
FIG. 6 is an enlarged side sectional illustration of a forward portion of the combustor wall of FIG. 4.
Figure 7:
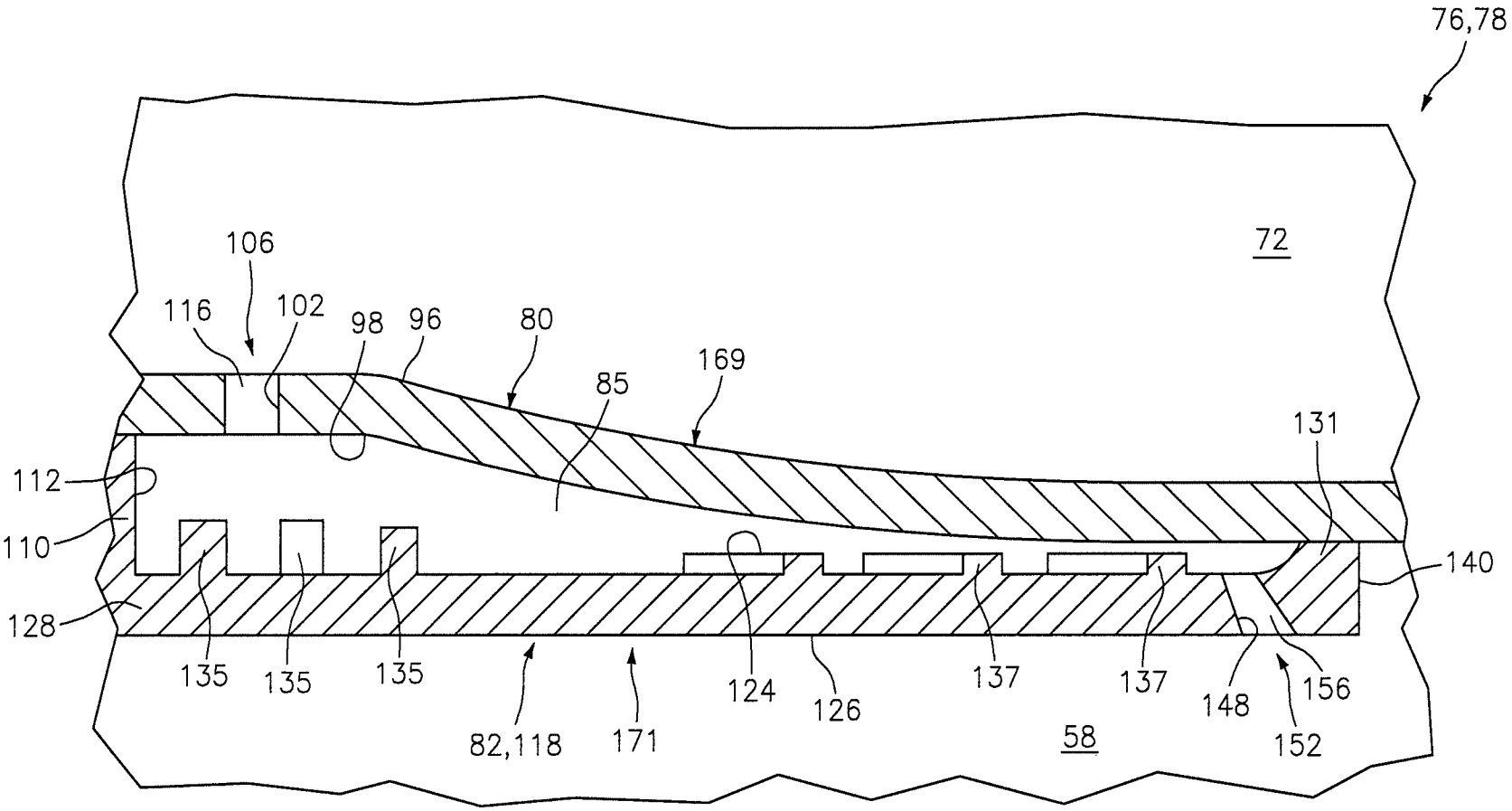
FIG. 7 is an enlarged side sectional illustration of an aft portion of the combustor wall of FIG. 4.

FIG. 4 is a side sectional illustration of an exemplary forward portion of one of the walls 76, 78 along the centerline 22. FIG. 5 is a circumferential sectional illustration of a portion of the wall 76, 78 of FIG. 4. FIG. 6 is an enlarged side sectional illustration of a forward portion of the wall 76, 78 of FIG. 4. FIG. 7 is an enlarged side sectional illustration of an aft portion of the wall 76, 78 of FIG. 4.

Figure 3:
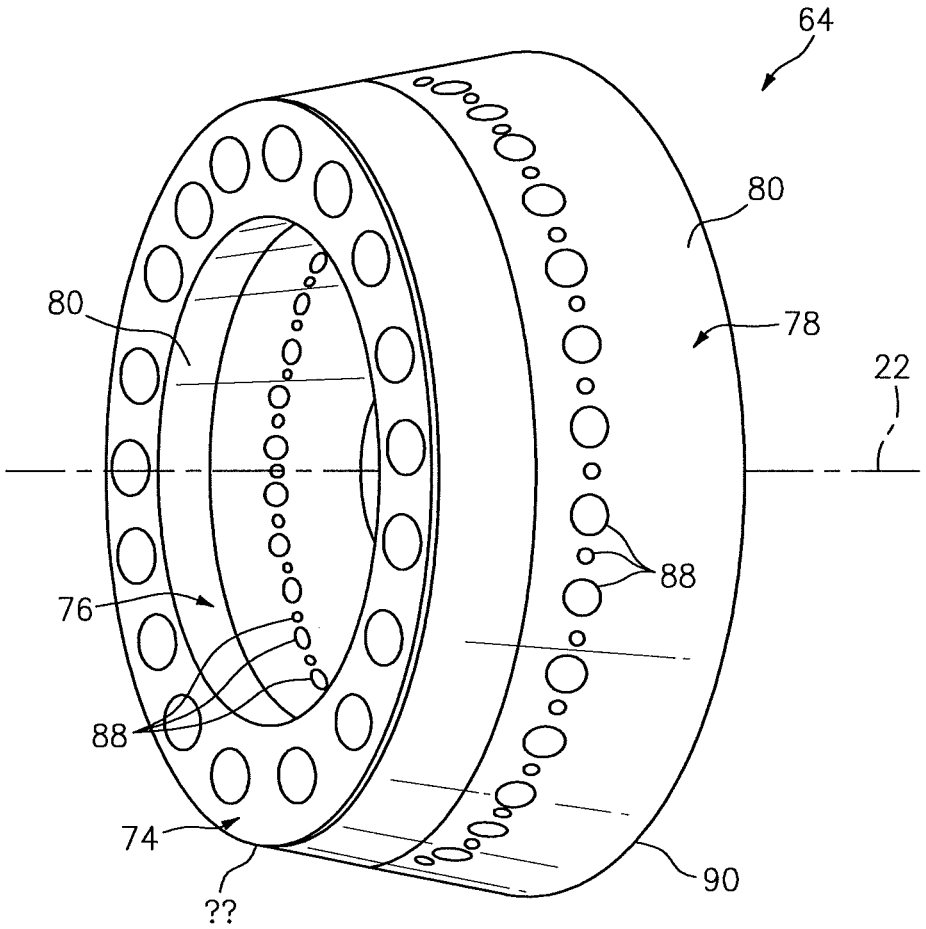
FIG. 3 is a perspective illustration of a portion of a combustor.

The inner wall 76 and the outer wall 78 may each be configured as a multi-walled structure; e.g., a hollow dual-walled structure. The inner wall 76 and the outer wall 78 of FIGS. 2 and 4, for example, each includes a tubular combustor shell 80, a tubular combustor heat shield 82, and one or more cooling cavities 84-86 (e.g., impingement cavities). Referring now to FIGS. 2 and 3, the inner wall 76 and the outer wall 78 may also each include one or more quench apertures 88. These quench apertures 88 extend through the wall 76, 78 and are disposed circumferentially around the centerline 22.

Referring to FIG. 2, the shell 80 extends circumferentially around the centerline 22. The shell 80 extends axially along the centerline 22 between an axial forward end 90 and an axial aft end 92. The shell 80 is connected to the bulkhead 74 at the forward end 90. The shell 80 may be connected to a stator vane assembly 94 or the HPT section 31A at the aft end 92.

Referring to FIG. 4, the shell 80 has a plenum surface 96, a cavity surface 98 and one or more aperture surfaces 100 and 102 (see also FIGS. 6 and 7). At least a portion of the shell 80 extends radially between the plenum surface 96 and the cavity surface 98. The plenum surface 96 defines a portion of the plenum 72. The cavity surface 98 defines a portion of one or more of the cavities 84-86 (see also FIG. 2).

The aperture surfaces 100 and 102 may be respectively arranged in one or more aperture arrays 104 and 106. The apertures surfaces 100, 102 in each aperture array 104, 106 may be disposed circumferentially around the centerline 22.

The aperture surfaces 100 in the first aperture array 104 may be located proximate (or adjacent) to and on a first axial side 108 of a respective heat shield panel rail 110 (e.g., intermediate rail). The aperture surfaces 102 in the second aperture array 106 may be located proximate (or adjacent) to and on an opposite second axial side 112 of the respective panel rail 110 (see FIGS. 4, 6, and 7).

Each of the aperture surfaces 100, 102 defines a respective cooling aperture 114, 116. Each cooling aperture 114, 116 extends (e.g., radially) through the shell 80 from the plenum surface 96 to the cavity surface 98. Each cooling aperture 114, 116 may be configured as an impingement aperture. Each aperture surface 100 of FIG. 6, for example, is configured to direct a jet of cooling air into the cooling cavity 84 to impinge substantially perpendicularly against the heat shield 82. Each aperture surface 102 of FIG. 7, for example, is configured to direct a jet of cooling air into the cooling cavity 85 to impinge substantially perpendicularly against the heat shield 82.

Referring to FIG. 2, the heat shield 82 extends circumferentially around the centerline 22. The heat shield 82 extends axially along the centerline 22 between an axial forward end and an axial aft end. The forward end is located at an interface between the wall 76, 78 and the bulkhead 74. The aft end may be located at an interface between the wall 76, 78 and the stator vane assembly 94 or the HPT section 31A.

The heat shield 82 may include one or more heat shield panels 118 and 120, one or more of which may have an arcuate geometry. The panels 118 and 120 are respectively arranged at discrete locations along the centerline 22. The panels 118 are disposed circumferentially around the centerline 22 in an array and generally form a forward hoop. The panels 120 are disposed circumferentially around the centerline 22 in an array and generally form an aft hoop. Alternatively, the heat shield 82 may be configured from one or more tubular bodies.

Referring to FIGS. 4-7, each heat shield panel 118 has one or more textured cavity surfaces 122 and 124 and a chamber surface 126. At least a portion of the panel 118 extends radially between the cavity surfaces 122 and 124 and the chamber surface 126. The cavity surface 122 defines a portion of a respective one of the cooling cavities 84. The cavity surface 124 defines a portion of a respective one of the cooling cavities 85. The chamber surface 126 defines a portion of the combustion chamber 58.

Each panel 118 includes a panel base 128, one or more rails (e.g., rails 110 and 130-133), one or more cooling elements 134-137. The panel base 128, the panel rails 110, 130, 132 and 133 and the cooling elements 134 and 136 may collectively define the first cavity surface 122. The panel base 128, the panel rails 110 and 131-133 and the cooling elements 135 and 137 may collectively define the second cavity surface 124. The panel base 128 may define the chamber surface 126.

The panel base 128 may be configured as a generally curved (e.g., arcuate) plate. The panel base 128 extends axially between an axial forward end 138 and an axial aft end 140. The panel base 128 extends circumferentially between opposing circumferential ends 142 and 144.

The panel base 128 has one or more aperture surfaces 146 and one or more aperture surfaces 148. These aperture surfaces 146 and 148 may be respectively arranged in one or more aperture arrays 150 and 152. The aperture surfaces 146, 148 in each array 150, 152 may be disposed circumferentially around the centerline 22. Respective aperture surfaces 146 in the forward array 150 may be adjacent (or in or proximate) the respective axial end rail 130 (see also FIG. 6). Respective aperture surfaces 148 in the aft array 152 may be adjacent (or in or proximate) the respective axial end rail 131 (see also FIG. 7).

Figure 8:
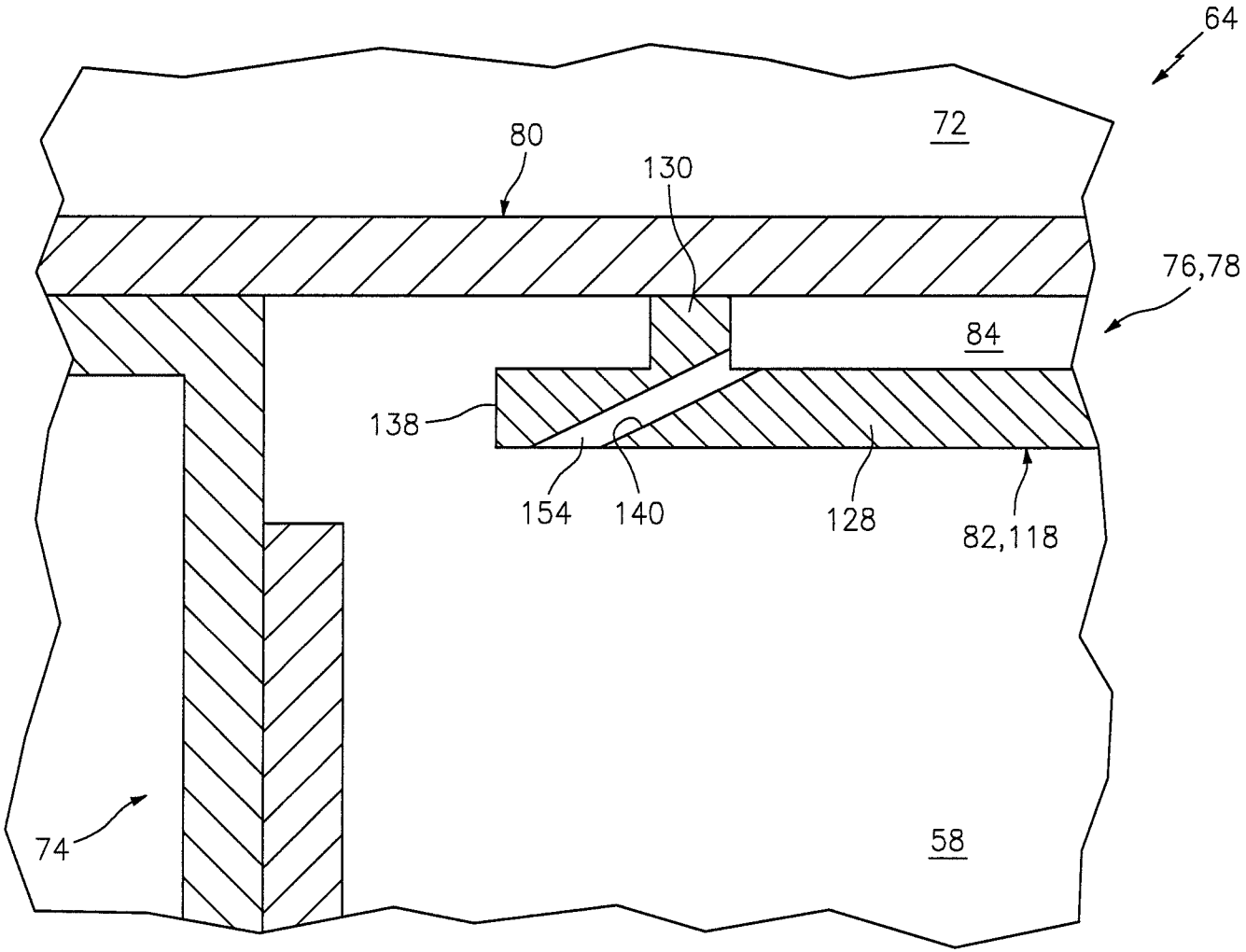
FIGS. 8 and 9 are side sectional illustrations of respective portions of alternative embodiment combustors.
Figure 9:
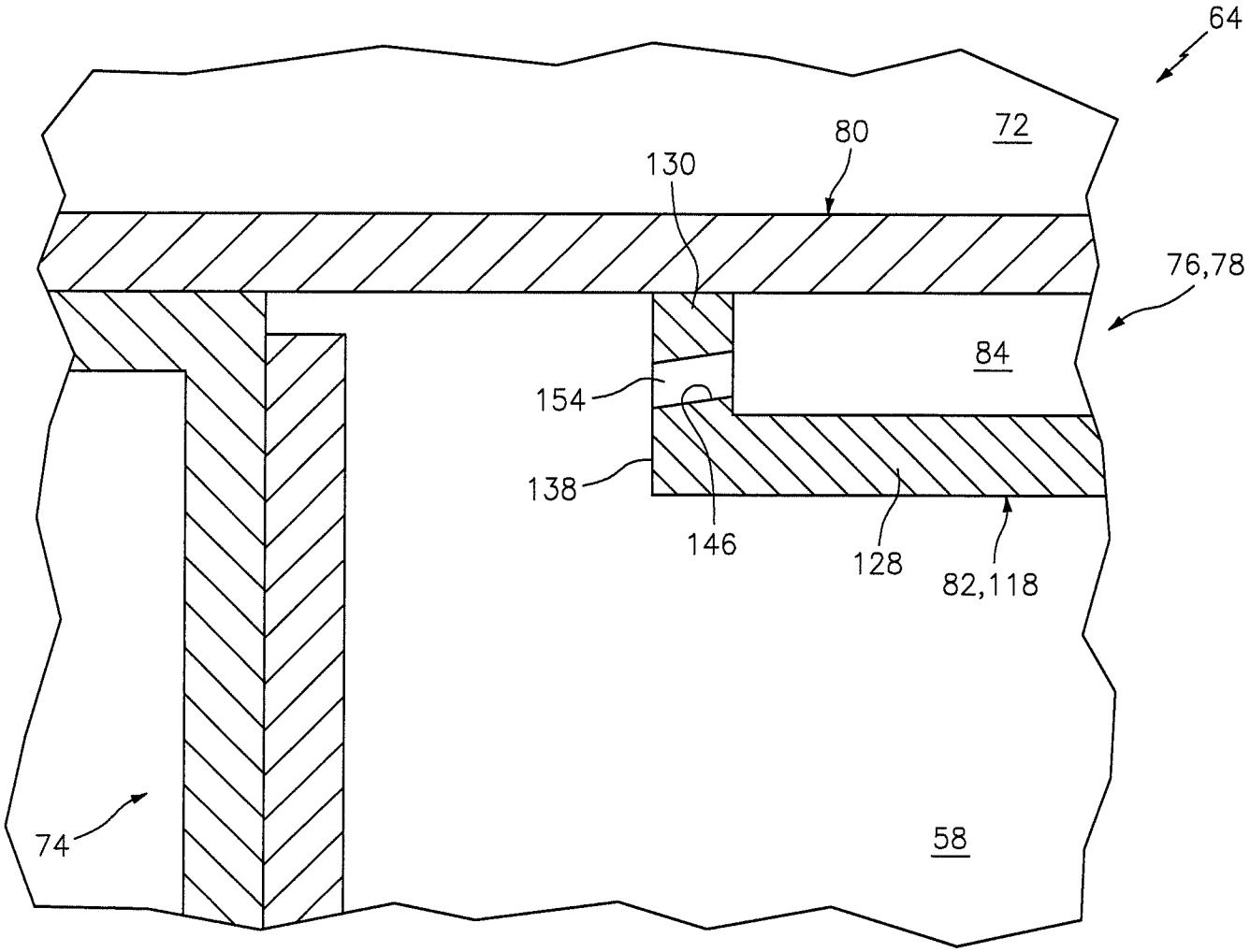

Referring to FIG. 6, each of the aperture surfaces 146 defines a cooling aperture 154 in the panel 118 and, thus, the heat shield 82. Each cooling aperture 154 may extend radially and axially (and/or circumferentially) through the panel base 128. Alternatively, referring to FIG. 8, one or more of the cooling apertures 154 may extend radially and axially (and/or circumferentially) through and be defined in the panel base 128 as well as the axial end rail 130. The aperture 154 of FIG. 8 extends through the rail 130 and the panel base 128 at the axial forward end 138. Referring to FIG. 9, one or more of the cooling apertures 154 may also or alternatively extend axially (and/or circumferentially) through and be defined in the axial end rail 130.

Referring to FIG. 6, one or more of the cooling apertures 154 may each be configured as an effusion aperture. Each aperture surface 146 of FIG. 6, for example, is configured to direct a jet of cooling air into the combustion chamber 58 such that the cooling air forms a film against a downstream portion of the heat shield 82. One or more of the aperture surfaces 146, however, may alternatively be configured to film and/or impingement cool the bulkhead 74 (see FIGS. 8 and 9).

Referring to FIG. 7, each of the aperture surfaces 148 defines a cooling aperture 156 in the panel 118 and, thus, the heat shield 82. Each cooling aperture 156 may extend radially and axially (and/or circumferentially) through the panel base 128. Alternatively, one or more of the cooling apertures 156 may extend radially and axially (and/or circumferentially) through and be defined in the panel base 128 as well as the axial end rail 131 in a similar manner as shown in FIG. 8. One or more of the cooling apertures 156 may also or alternatively extend axially (and/or circumferentially) through and be defined in the axial end rail 131 in a similar manner as shown in FIG. 9.

Referring to FIG. 7, one or more of the cooling apertures 156 may each be configured as an effusion aperture. Each aperture surface 148 of FIG. 7, for example, is configured to direct a jet of cooling air into the combustion chamber 58 such that the cooling air forms a film against a downstream portion of the heat shield 82; e.g., against the heat shield panels 120.

Referring to FIGS. 2, 4 and 5, the panel rails may include the axial intermediate rail 110, one or more axial end rails 130 and 131, and one more circumferential end rails 132 and 133. Each of the panel rails 110 and 130-133 of the inner wall 76 extends radially in from the respective panel base 128. Each of the panel rails 110 and 130-133 of the outer wall 78 extends radially out from the respective panel base 128.

Referring to FIGS. 4 and 5, the axial intermediate and end rails 110, 130 and 131 extend circumferentially between and are connected to the circumferential end rails 132 and 133. The axial intermediate rail 110 is disposed axially (e.g., centrally) between the axial end rails 130 and 131. The axial end rail 130 is arranged at the forward end 138. The axial end rail 131 is arranged at the aft end 140. The circumferential end rail 132 is arranged at the circumferential end 142. The circumferential rail 133 is arranged at the circumferential end 144.

Referring to FIGS. 4-7, the cooling elements 134-137 are connected to the panel base 128 on a side of the base 128 that faces the shell 80. One or more of the cooling elements 134-137, for example, may be formed integral with the panel base 128. One or more of the cooling elements 134-137 may alternatively be welded, brazed, adhered, mechanically fastened or otherwise attached to the panel base 128.

Referring now to FIGS. 6 and 7, each cooling element 134-137 extends from the panel base 128 to a respective distal end, thereby defining a respective vertical (e.g., radial) cooling element height. This cooling element height may be, for example, between about twenty-five percent (25%) and about sixty percent (60%) or more of a vertical (e.g., radial) thickness of the shell 80. In another example, the cooling element height may be between about thirty percent (30%) and about fifty percent (50%) a vertical (e.g., radial) height of the respective cooling cavity 84, 85. The present invention, however, is not limited to any particular cooling element sizes.

Referring to FIGS. 5 and 6, the cooling elements 134 are arranged in one or more arrays located at discrete locations along the centerline 22. The cooling elements 134 in each array are disposed circumferentially about the centerline 22. The cooling elements 134 are arranged on the first axial side 108 of the intermediate rail 110, thereby providing a portion 158 of the cavity surface 122 at (e.g., on, adjacent or proximate) the rail 110 with its texture.

The cooling elements 136 are arranged in one or more arrays located at discrete locations along the centerline 22. The cooling elements 136 in each array are disposed circumferentially about the centerline 22. The cooling elements 136 are arranged proximate the axial end rail 130. The cooling elements 136 in a forward (e.g., forward-most) one of the arrays, for example, are disposed next to the cooling apertures 154; e.g., not separated by other panel features or cooling elements. In this manner, the cooling elements 136 provide a portion 160 of the cavity surface 122 at the cooling apertures 154 and proximate the axial end rail 130 with its texture.

Referring to FIGS. 5 and 7, the cooling elements 135 are arranged in one or more arrays located at discrete locations along the centerline 22. The cooling elements 135 in each array are disposed circumferentially about the centerline 22. The cooling elements 135 are arranged on the second axial side 112 of the intermediate rail 110, thereby providing a portion 162 of the cavity surface 124 at the rail 110 with its texture.

The cooling elements 137 are arranged at discrete locations along the centerline 22. The cooling elements 137 are arranged proximate the axial end rail 131. An aft (e.g., aft-most) one of the cooling elements 137, for example, is disposed next to the cooling apertures 156; e.g., not separated by other panel features or cooling element(s). In this manner, the cooling elements 137 provide a portion 164 of the cavity surface 124 at the cooling apertures 156 and proximate the axial end rail 131 with its texture.

Figure 10:
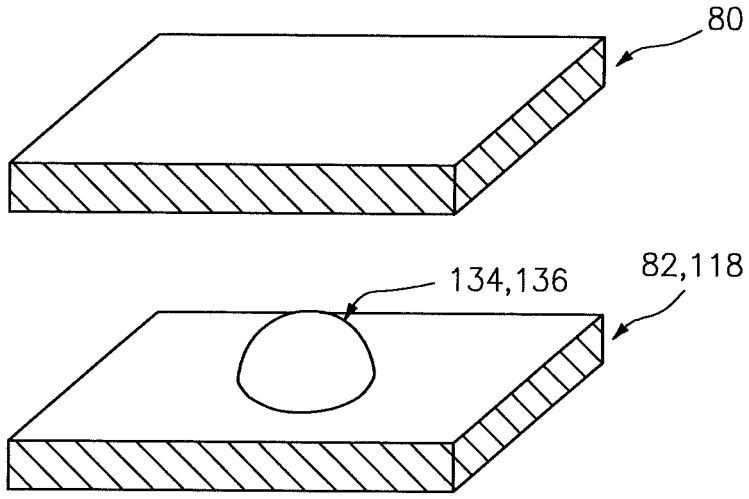
FIGS. 10 and 11 are perspective illustrations of respective portions of alternative embodiment combustor walls.
Figure 11:
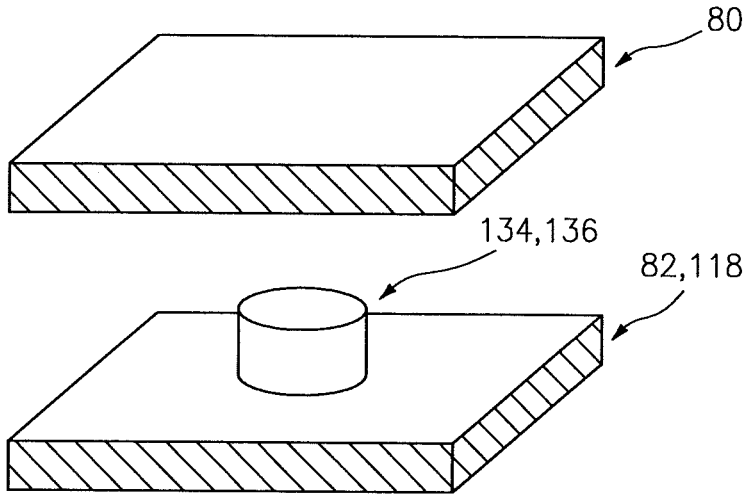

Referring to FIGS. 5-7, the cooling elements 134 and 135 may be arranged and/or configured to provide the cavity surface portions 158 and 162 with the same textures. For example, each of the cooling elements 134, 135 may be configured as a point protrusion such as, for example, a nodule (see FIG. 10) or a pin (see FIG. 11). A cooling element density of the cooling elements 134 in the cavity surface portion 158 may be substantially equal to a cooling element density of the cooling elements 135 in the cavity surface portion 162. The term "cooling element density" may describe a ratio of a quantity of cooling elements per square unit of cavity surface. An element surface density of the cooling elements 134 in the cavity surface portion 158 may be substantially equal to an element surface density of the cooling elements 135 in the cavity surface portion 162. The term "element surface density" may describe a ratio of collective surface area of cooling elements in a square unit of cavity surface to a total surface area of the square unit of cavity surface. Of course, in alternative embodiments, the cooling elements 134 and 135 may be arranged and/or configured to provide the cavity surface portions 158 and 162 with different textures.

The cooling elements 136 and 137 may be arranged and/or configured to provide the cavity surface portions 160 and 164 with different textures. For example, each of the cooling elements 136 may be configured as a point protrusion such as, for example, a nodule (see FIG. 10) or a pin (see FIG. 11). In contrast, each of the cooling elements 137 may be configured as a rib with, for example, one or more portions respectively configured as chevrons. A cooling element density of the cooling elements 136 in the cavity surface portion 160 may be different (e.g., greater or less) than a cooling element density of the cooling elements 137 in the cavity surface portion 164. An element surface density of the cooling elements 136 in the cavity surface portion 160 may be different (e.g., less or greater) than an element surface density of the cooling elements 137 in the cavity surface portion 164. Of course, in alternative embodiments, the cooling elements 136 and 136 may be arranged and/or configured to provide the cavity surface portions 160 and 164 with the same or similar textures.

Surface texture of a component may influence convective thermal energy transfer between the component and air flowing over its surface. The convective thermal energy transfer between the component and the air, for example, may decrease where the surface texture is relatively smooth; e.g., the component includes a small number of and/or short cooling elements or any other type of perturbation features that form the surface. In contrast, the convective thermal energy transfer between the component and the air may increase where the surface texture is relatively coarse; e.g., the component includes a large number of and/or tall cooling elements or any other type of perturbation features that form the surface.

In addition to the foregoing, a rib may provide the component with a higher thermal energy transfer coefficient than an array of nodules or pins. The rib, for example, may have more exposed surface area available for thermal energy transfer than the nodule or pin array. The rib may also or alternatively turbulate the air more effectively than the nodule or pin array, thereby creating secondary vortices in the air that may increase thermal energy transfer. Thus, referring again to FIGS. 5-7, a thermal energy transfer coefficient of the cavity surface portion 164 may be different (e.g., greater) than thermal energy transfer coefficients of the cavity surface portions 158, 160 and/or 162, which may be substantially equal.

Referring to FIG. 2, the heat shield 82 of the inner wall 76 circumscribes the shell 80 of the inner wall 76, and defines an inner side of the combustion chamber 58. The heat shield 82 of the outer wall 78 is arranged radially within the shell 80 of the outer wall 78, and defines an outer side of the combustion chamber 58 that is opposite the inner side. The heat shield 82 and, more particularly, each of the panels 118 and 120 may be respectively attached to the shell 80 by a plurality of mechanical attachments 166 (e.g., threaded studs respectively mated with washers and nuts); see also FIG. 4. The shell 80 and the heat shield 82 thereby respectively faun the cooling cavities 84-86 in each of the walls 76, 78.

Referring to FIGS. 4 and 5, each cooling cavity 84 is defined radially by and extends radially between the cavity surface 98 and a respective one of the cavities surfaces 122 as set forth above. Each cooling cavity 84 is defined circumferentially by and extends circumferentially between the end rails 132 and 133 of a respective one of the panels 118. Each cooling cavity 84 is defined axially by and extends axially between the rails 110 and 130 of a respective one of the panels 118. In this manner, each cooling cavity 84 may fluidly couple one or more of the cooling apertures 114 with one or more of the cooling apertures 154.

Each cooling cavity 85 is defined radially by and extends radially between the cavity surface 98 and a respective one of the cavities surfaces 124 as set forth above. Each cooling cavity 85 is defined circumferentially by and extends circumferentially between the end rails 132 and 133 of a respective one of the panels 118. Each cooling cavity 85 is defined axially by and extends axially between the rails 110 and 131 of a respective one of the panels 118. In this manner, each cooling cavity 85 may fluidly couple one or more of the cooling apertures 116 with one or more of the cooling apertures 156.

Referring to FIGS. 6 and 7, respective portions 168-171 of the shell 80 and the heat shield 82 may converge towards one another; e.g., the shell portions 168 and 169 may include concavities. In this manner, a vertical distance between the shell 80 and the heat shield 82 (e.g., the radial height of the cavity 84, 85) may decrease as each panel 118 extends from the intermediate rail 110 to its axial end rails 130, 131. A vertical height of each intermediate rail 110, for example, may be greater than vertical heights of the respective axial end rails 130, 131. The height of each axial end rail 130, 131, for example, is between about twenty percent (20%) and about fifty percent (50%) of the height of the intermediate rail 110. The shell 80 and the heat shield 82 of FIGS. 6 and 7 therefore may define each cooling cavity 84, 85 with a tapered geometry. However, in other embodiments, one or more of the cooling cavities 84 and/or 85 may be defined with non-tapered geometries as illustrated, for example, in FIG. 2.

Referring to FIGS. 5 and 6, core air from the plenum 72 is directed into each cooling cavity 84, 85 through respective cooling apertures 114 and 116 during turbine engine operation. This core air (e.g., cooling air) may impinge against the respective panel base 128 and/or the cooling elements 134 and 135, thereby impingement cooling the panel 118 and the heat shield 82.

The cooling air may flow axially within the respective cooling cavities 84 and 85 from the cooling apertures 114, 116 to the cooling apertures 154, 156. The converging surfaces 98 and 122, 98 and 124 may accelerate the axially flowing cooling air as it flows towards a respective one of the axial end rails 130, 131. By accelerating the cooling air, thermal energy transfer from the heat shield 82 to the shell 80 through the cooling air may be increased. Convective thermal energy transfer may also be increased by the cooling elements 134-137 as described above. In particular, the texture of the cavity surface portion 164 may be tailored to have a relatively high thermal energy transfer coefficient. As a result, the aft portion of the panels 118 may be subjected to higher core air temperatures within the combustion chamber 58 during turbine engine operation than the forward and intermediate portions of the panels 118.

Referring to FIG. 6, the respective cooling apertures 154 may direct substantially all of the cooling air within the cooling cavity 84 into the combustion chamber 58. This cooling air may subsequently form a film that film cools a downstream portion of the heat shield 82; e.g., a downstream portion of the respective panel 118. The cooling air may also or alternatively provide film cooling or impingement cooling to the bulkhead 74 (see FIG. 2).

Referring to FIG. 7, the respective cooling apertures 156 may direct substantially all of the cooling air within the cooling cavity 85 into the combustion chamber 58. This cooling air may subsequently form a film that film cools a downstream portion of the heat shield 82; e.g., an upstream portion of the respective panel 120.

Figure 12:
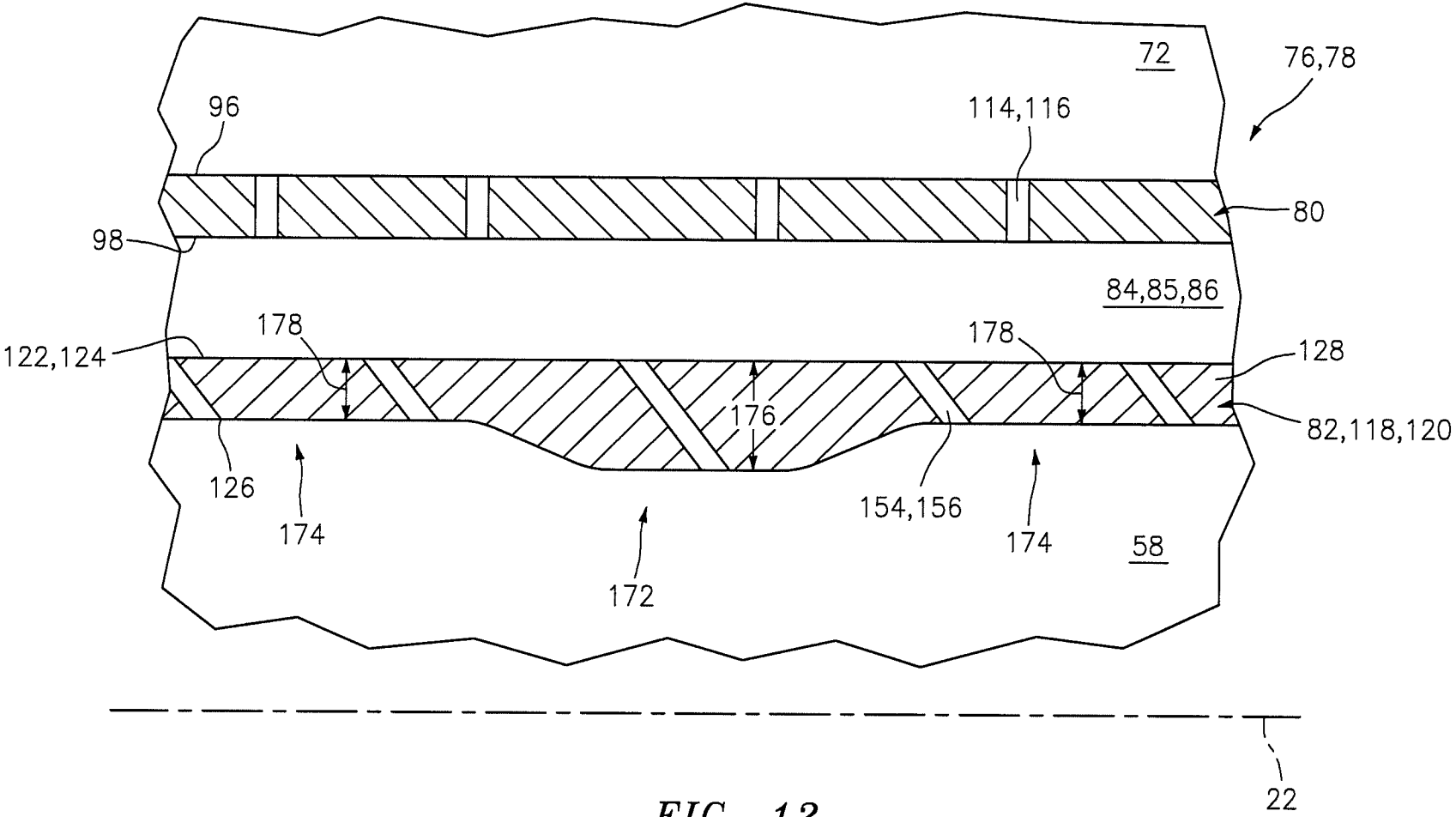
FIG. 12 is a side sectional illustration of a portion of an alternate embodiment combustor wall.

Referring to FIG. 12, in some embodiments, the panel base 128 may be configured with at least one thick portion 172 and one or more thin portions 174. The thick portion 172 has a vertical (e.g., radial) thickness 176 that is greater than a vertical thickness 178 of the thin portions 174. The thickness 176, for example, may be between about one and one-quarter times (1¼×) and about three times (3×) the thickness 178.

The thick portion 172 may be disposed axially between and adjacent to the thin portions 174 as shown in FIG. 12. Alternatively, the thick portion 172 may be arranged circumferentially between and adjacent to the thin portions 174. Furthermore, in some embodiments, the panel base 128 may be configured with a plurality of the thick portions 172 and at least one of the thin portions 174.

By varying the thickness of the panel base 128 as described above, the temperature profile of the panel 118, 120 can be further tailored. For example, the thick portion 172 of FIG. 12 may have a lower operating temperature than the thin portions 174. The thick portion 172 also provides additional material for alloy oxidation. In addition, where the transitions between the thick portion 172 and the thin portions 174 are defined by the surface 126 and are relatively gradual, the Coanda effect may aid in keeping a film of cooling air "attached" to the chamber surface 126. The transition between the thick portion 172 and the thin portions 174, however, may alternatively be defined by the surface 122, 124 such that the thick portion 172 increases the length of the respective apertures 154, 156 without disturbing airflow within the combustion chamber 58. Still alternatively, the transitions may be defined by the surface 126 as well as the surface 122, 124.

The shell 80 and/or the heat shield 82 may each have a configuration other than that described above. In some embodiments, for example, a respective one of the heat shield portions 170 and 171 may have a concavity that defines the cooling cavity tapered geometry with the concavity of a respective one of the shell portions 168 and 169. In some embodiments, a respective one of the heat shield portions 170, 171 may have a concavity rather than a respective one of the shell portions 168, 169. In some embodiments, one or more of the afore-described concavities may be replaced with a substantially straight radially tapering wall. In some embodiments, each panel 118 may define one or more additional cooling cavities with the shell 80. In some embodiments, each panel 118 may define a single cooling cavity (e.g., 84 or 85) with the shell 80, which cavity may taper in a forward or aftward direction. In some embodiments, one or more of the panels 120 may have a similar configuration as that described above with respect to the panels 118. The present invention therefore is not limited to any particular combustor wall configurations.

In some embodiments, the bulkhead 74 may also or alternatively be configured with a multi-walled structure (e.g., a hollow dual-walled structure) similar to that described above with respect to the inner wall 76 and the outer wall 78. The bulkhead 74, for example, may include a shell, a heat shield, one or more cooling elements, and one or more cooling cavities. Similarly, other components (e.g., a gas path wall, a nozzle wall, etc.) within the turbine engine 20 may also or alternatively include a multi-walled structure as described above.

The terms "forward", "aft", "inner", "outer", "radial", circumferential" and "axial" are used to orientate the components of the turbine engine assembly 62 and the combustor 64 described above relative to the turbine engine 20 and its centerline 22. One or more of these components, however, may be utilized in other orientations than those described above. The present invention therefore is not limited to any particular spatial orientations.

The turbine engine assembly 62 may be included in various turbine engines other than the one described above. The turbine engine assembly 62, for example, may be included in a geared turbine engine where a gear train connects one or more shafts to one or more rotors in a fan section, a compressor section and/or any other engine section. Alternatively, the turbine engine assembly 62 may be included in a turbine engine configured without a gear train. The turbine engine assembly 62 may be included in a geared or non-geared turbine engine configured with a single spool, with two spools (e.g., see FIG. 1), or with more than two spools. The turbine engine may be configured as a turbofan engine, a turbojet engine, a propfan engine, or any other type of turbine engine. The present invention therefore is not limited to any particular types or configurations of turbine engines.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. A structure for a turbine engine, the structure comprising:

a shell including a first surface; and a heat shield including a rail, a textured second surface, a textured third surface, a plurality of first cooling elements and a plurality of second cooling elements, the texture of a first portion of the second surface different than the texture of a first portion of the third surface, the first cooling elements partially defining the second surface, the second cooling elements partially defining the third surface, and a first of the first cooling elements having a different geometric configuration than a first of the second cooling elements;

wherein the first surface and the second surface define a first cooling cavity between the shell and the heat shield, and the first surface and the third surface define a second cooling cavity between the shell and the heat shield;

wherein each cooling cavity tapers in height as the respective cooling cavity extends away from the rail;

wherein the rail fluidly isolates the first cooling cavity from the second cooling cavity.

2. The structure of claim 1, wherein the heat shield defines first cooling apertures at the first portion of the second surface with the first cooling apertures fluidly coupled with the first cooling cavity; and second cooling apertures at the first portion of the third surface with the second cooling apertures fluidly coupled with the second cooling cavity.

3. The structure of claim 2, wherein the rail is between the second surface and the third surface, and the texture of a second portion of the second surface at the rail is substantially the same as the texture of a second portion of the third surface at the rail.

4. The structure of claim 1, wherein a density of the first cooling elements is different than a density of the second cooling elements.

5. The structure of claim 1, wherein the first of the first cooling elements comprises a point protrusion; and the first of the second cooling elements comprises a rib.

6. The structure of claim 5, wherein the point protrusion is configured as a nodule or a pin.

7. The structure of claim 5, wherein at least a portion of the rib is configured as a chevron.

8. The structure of claim 5, wherein the heat shield defines first cooling apertures fluidly coupled with the first cooling cavity and second cooling apertures fluidly coupled with the second cooling cavity, the point protrusion is disposed next to one of the first cooling apertures, and the rib is disposed next to one or more of the second cooling apertures.

9. The structure of claim 8, wherein the heat shield includes first and second end rails;

the heat shield defines the first cooling apertures at the first end rail; and the heat shield defines the second cooling apertures at the second end rail.

10. The structure of claim 9, wherein at least one of the first cooling cavity is configured to direct substantially all first cavity air which enters the first cooling cavity through the first cooling apertures; or the second cooling cavity is configured to direct substantially all second cavity air which enters the second cooling cavity through the second cooling apertures.

11. The structure of claim 1, wherein the heat shield includes a plurality of heat shield panels, and one of the plurality of heat shield panels includes the second surface and the third surface.

12. The structure of claim 1, wherein the first surface and the second surface converge towards one another, and the first surface and the third surface converge towards one another.

13. The structure of claim 1, wherein the first cooling cavity fluidly couples a plurality of shell cooling apertures defined in the shell with a plurality of heat shield cooling apertures defined in the heat shield at a second rail, and the heat shield is configured such that substantially all air within the first cooling cavity is directed through the heat shield cooling apertures defined in the heat shield at the second rail.

14. The structure of claim 1, wherein the heat shield includes a base that at least partially defines the second surface and the third surface, and a first portion of the base is thicker than a second portion of the base.

15. A structure for a turbine engine, the structure comprising:

a shell and a heat shield with first and second cooling cavities between the shell and the heat shield, the first cooling cavity fluidly isolated from the second cooling cavity by a rail within the structure;

wherein the heat shield includes a plurality of first cooling elements and a plurality of second cooling elements, the first cooling elements extend partially into the first cooling cavity, one of the first cooling elements comprises a point protrusion, the second cooling elements extend partially into the second cooling cavity, and one of the second cooling elements comprises a rib;

wherein each cooling cavity tapers in height as the respective cooling cavity extends away from the rail.

16. The structure of claim 15, wherein the first cooling cavity or the second cooling cavity is defined vertically between a surface of the shell and a surface of the heat shield that converge towards one another.

17. The structure of claim 15, wherein the heat shield defines cooling apertures at the rail fluidly coupled with one of the first cooling cavity and the second cooling cavity, and configured to outwardly direct substantially all air entering the one cooling cavity through the cooling apertures.

18. The structure of claim 15, wherein the heat shield includes a base that at least partially defines the first and the second cooling cavities and a first portion of the base is thicker than a second portion of the base.

19. The structure of claim 1, wherein the first of the second cooling elements is configured as a rib comprising a plurality of chevrons; and a first of the chevrons is directedly connected to and contiguous with, in an end-to-end fashion, a second of the chevrons and a third of the chevrons.

* * * * *